United States Patent [19]

Kato et al.

[11] Patent Number: 4,841,556

[45] Date of Patent: Jun. 20, 1989

[54] PLASMA X-RAY SOURCE

[75] Inventors: Yasuo Kato, Zama; Isao Ochiai, Hachioji; Yoshio Watanabe, Tokyo; Seiichi Murayama, Kokubunji, all of Japan

[73] Assignee: Hitachi, Ltd., Tokyo, Japan

[21] Appl. No.: 12,992

[22] Filed: Feb. 10, 1987

[30] Foreign Application Priority Data

Mar. 7, 1986 [JP] Japan ..... 61-48258

[51] Int. Cl.[4] ..... H01J 35/00

[52] U.S. Cl. ..... 378/119; 378/34; 315/111.21; 315/111.71

[58] Field of Search ..... 378/34–35, 378/119, 161, 121; 315/111.21, 111.71; 376/144–145

[56] References Cited

U.S. PATENT DOCUMENTS

| | | | |
|---|---|---|---|
| 3,946,240 | 3/1976 | Roberts et al. | 376/145 |
| 3,959,659 | 5/1976 | Roberts et al. | 376/145 |
| 4,301,391 | 11/1981 | Seliger et al. | 315/111.21 |
| 4,538,291 | 8/1985 | Iwamatsu | 378/34 |
| 4,596,030 | 6/1986 | Herzinger et al. | 378/34 |
| 4,627,086 | 12/1986 | Kato et al. | 378/34 |
| 4,635,282 | 1/1987 | Okuda et al. | 378/34 |
| 4,644,576 | 2/1987 | Kuyel | 378/34 |
| 4,648,106 | 3/1987 | Novak | 378/34 |
| 4,663,567 | 5/1987 | Wong | 378/119 |
| 4,715,054 | 12/1987 | Kato et al. | 315/111.21 |

FOREIGN PATENT DOCUMENTS

| | | | |
|---|---|---|---|
| 0397917 | 10/1981 | European Pat. Off. | 378/34 |
| 0086743 | 5/1985 | Japan | 378/119 |

OTHER PUBLICATIONS

"X-Ray Lithography Using a Pulsed Plasma Source", by Pearlman et al., J. Vac. Sci. Technol., 19 (4), Nov./-Dec. 1981, pp. 1190–1193.

*Primary Examiner*—Janice A. Howell
*Assistant Examiner*—John C. Freeman
*Attorney, Agent, or Firm*—Antonelli, Terry & Wands

[57] ABSTRACT

A plasma X-ray source in which a discharge tube containing a pair of coaxial cylindrical electrodes is filled with a gas, a high voltage pulse from a charged capacitor is applied between the cylindrical electrodes to convert the gas into a plasma, the plasma is focused on a position near the end of the inner one of the cylindrical electrodes to generate X-rays, and the X-rays thus generated are emitted to the outside of the discharge tube through a window provided thereon, is disclosed. In the above X-ray source, the high voltage pulse is applied between the cylindrical electrodes so that the inner cylindrical electrode is at a negative potential with respect to the outer cylindrical electrode.

5 Claims, 1 Drawing Sheet

PLASMA X-RAY SOURCE

BACKGROUND OF THE INVENTION

The present invention relates to a plasma X-ray source for producing a high-temperature, high-density plasma by pulse discharge to generate soft X-rays, and more particularly to a plasma X-ray source suitable for use in X-ray lithography for producing submicron integrated circuits or X-ray microscope.

A plasma focus consists of a pair of cylindrical electrodes which are disposed coaxially and insulated from each other by a glass insulator, and is filled with a gas such as deuterium. A pulse voltage from a charged capacitor is applied between the cylindrical electrodes and ionizes the gas, thereby producing a plasma. The plasma thus produced travels between the cylindrical electrodes, and is focused on a position near the open ends of the electrodes. The plasma thus focused is compressed by a pressure of a magnetic field, into a high-temperature, high-density plasma, which generates neutrons. That is, the plasma focus has hitherto been used as a neutron source. However, the high-temperature, high-density plasma formed in the plasma focus also emits soft X-rays. Thus, a plasma focus for a soft X-ray source has been studied, in recent years. A soft X-ray source using a plasma focus is described in, for example, JP-A-No. 60-84749 which is corresponding to U.S. Pat. No. 4,596,030.

An X-ray exposure apparatus and an X-ray microscope require a bright soft X-ray source. In order to use a plasma focus as a soft X-ray source, it is necessary to solve the following problems.

X-rays emitted from a high-temperature plasma which is formed in a plasma focus, are absorbed by a gas contained in the discharge tube and a window thereof, and are then emitted to the outside. In order to emit high-luminance X-rays from the discharge tube, it is required not only to increase the intensity of X-rays generated by the plasma but also to reduce the absorption of X-rays by the gas and window. In order to reduce the absorption of X-rays by the gas in the discharge tube, it is necessary to lower a pressure, at which the discharge tube is filled, and to shorten an X-ray path in the discharge tube. Further, in order to reduce the absorption of X-rays by the window, it is necessary to decrease the thickness of a window material such as beryllium and polymer.

SUMMARY OF THE INVENTION

It is an object of the present invention to provide a high-luminance plasma X-ray source.

In order to attain the above object, according to the present invention, there is provided a plasma focus X-ray source in which, contrary to a conventional plasma focus, a negative (pulse) voltage is applied to the inner electrode. In the conventional plasma focus discharge tube which is filled with deuterium to generate neutrons, a pulse voltage is applied between a pair of cylindrical electrodes so that the inner one of the cylindrical electrodes is at a positive potential with respect to the outer cylindrical electrode, to increase the yield of neutrons. While, in a plasma X-ray source using a plasma focus, the discharge tube is filled with a gaseous element of a large atomic number such as neon, argon, krypton and xenon, at a relatively low pressure, to emit an X-ray beam, in stead of a neutron beam. The present inventors found that in a plasma X-ray source, the application of a pulse voltage between a pair of coaxial cylindrical electrodes in such a manner that the inner electrode was at a negative potential with respect to the outer electrode, was superior in many points to the application of the pulse voltage so that the inner electrode was at a positive potential with respect to the outer electrode.

DESCRIPTION OF THE PREFERRED EMBODIMENT

Figure 1:
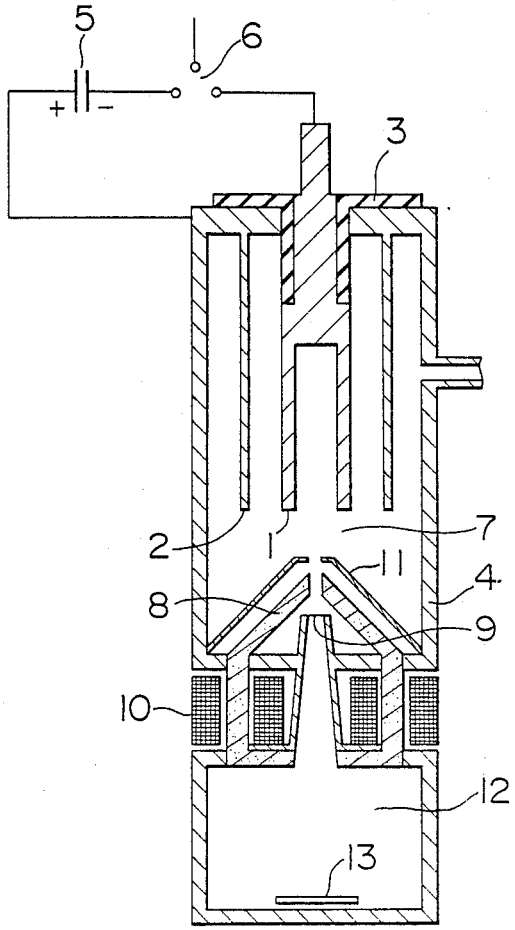
FIG. 1 is a sectional view showing an embodiment of a plasma X-ray source according to the present invention.

The principle of the present invention will first be explained in detail.

In a plasma focus discharge tube according to the present invention for generating soft X-rays in such a manner that at least one of gaseous elements such as neon, argon, krypton and xenon is ionized to produce a plasma, and the plasma thus obtained is focused on a predetermined position and compressed into a high-temperature, high-density plasma, thereby generating soft X-ray, a pulse voltage is applied between a pair of coaxial cylindrical electrodes so that the inner one of the cylindrical electrodes is at a negative potential with respect to the outer cylindrical electrode. When the pulse voltage is applied as mentioned above, ions in the plasma are attracted to the inner electrode by an electric field formed between the outer and inner electrodes, and electrons in the plasma are attracted to the outer electrode by the electric field. Thus, when the plasma moves towards the open ends of the electrodes, ions in the plasma are concentrated towards the inner electrode. As a result, the number of ions gathered at the open end of the inner electrode is far greater than that in a case where the inner electrode is at a positive potential with respect to the outer electrode. Accordingly, a high-temperature, high-density plasma can be formed at the open end of the inner electrode, at a pressure of the gaseous element lower than that required for the case where the inner electrode is at a positive potential with respect to the outer electrode. Thus, the discharge tube can be operated at a relatively low pressure, and the absorption of X-rays by the gas within the discharge tube can be reduced. It was confirmed by experiments that the gas pressure required for the case where the inner electrode is an anode, is several times higher than the gas pressure required for the case where the inner electrode is a cathode.

In addition to X-rays, charged particles (that is, ions and electrons) are emitted from a high-temperature, high-density plasma which has been compressed by a pressure of a magnetic field. The kinetic energy of the charged particles is so large that the electrodes are sputtered and a thin beryllium film for transmitting X-rays is damaged by the bombardment of charged particles. The damage to the beryllium film caused by the charged particles can be prevented by forming a magnetic field in front of the beryllium film, thereby deflecting the charged particles from directions towards the beryllium film. An electron is large in specific charge (namely, ratio of charge to mass). Accordingly, a relatively weak magnetic field can deviate an electron from its moving direction by a predetermined amount. While, an ion is small in specific charge. Accordingly, a strong magnetic field is required for deviating an ion from its moving direction by the predetermined amount. Preferably, the plasma focus discharge tube is provided with the X-ray transmitting window at a position which confronts the open end of the inner electrode on the axis of the discharge tube. In this case, the source size viewed from the window becomes smallest, and X-rays brightness becomes maximum. In such an arrangement, it is desirable from the structural point of view that the potential of the X-ray transmitting window is made equal to that of the outer electrode.

When a pulse voltage is applied between the outer and inner cylindrical electrodes so that the outer electrode is at a positive potential with respect to the inner electrode, the beryllium film (that is, the X-ray transmitting window) kept at the same potential as the outer electrode is bombarded with electrons. However, the bombardment of electrons can be readily prevented by forming a magnetic field in front of the beryllium film.

Further, when the pulse voltage is applied in the above-mentioned manner, positive ions collide with the inner electrode, and an X-ray intensity emitted from the inner electrode surface by the above collision is far smaller than that in a case where the inner electrode is at a positive potential with respect to the outer electrode. The X-ray emitted from the inner electrode surface becomes a background of the X-ray emitted from the plasma, increases the source size, and hence decreases the accuracy of the printed pattern.

Further, the consumption of the electrodes can be reduced by operating the discharge tube in a state that the outer electrode is at a positive potential with respect to the inner electrode. The energy of a current flowing between the inner and outer electrodes is held mainly by electrons, and the electrodes are consumed by the collision with electrons. When the inner electrode having a relatively small surface area is used as an anode, the electron density at the surface of the inner electrode becomes large. Thus, the inner electrode is evaporated violently by electron bombardment, and moreover the beryllium film is contaminated greatly with the evaporated electrode material. When the inner electrode is the cathode in accordance with the present invention, the density of an electronic current at the inner surface of the outer electrode is small, since the outer electrode has a large surface area. Thus, the outer electrode is consumed only a little, and the contamination of the beryllium film is reduced.

Further, when the outer electrode is used as the anode, the temperature rise of the anode is smaller than that in a case where the inner electrode is used as the anode, for the same reason as mentioned above. Moreover, the outer electrode is easy to cool.

Now, explanation will be made of an embodiment of a plasma X-ray source according to the present invention.

FIG. 1 is a sectional view showing the above embodiment. Referring to FIG. 1, an inner cylindrical electrode 1 is insulated electrically from an outer cylindrical electrode 2 by an insulator 3. The inner electrode 1 is connected to a terminal of a capacitor 5 through a spark gap switch 6, and another terminal of the capacitor 5 is connected to the outer electrode 2. The capacitor 5 is charged to a high voltage so that the terminal connected to the inner electrode 1 through the switch 6 is at a negative potential with respect to the terminal connected to the outer electrode 2. A discharge space 7 enclosed by a vessel 4 is filled with at least one of gaseous elements such as neon, argon, krypton and xenon at a pressure of 0.1 to 10 Torr. When the high voltage is applied between the inner electrode 1 and the outer electrode 2 by turning on the switch 6, breakdown occurs along the surface of the insulator 3, and a plasma is produced. The plasma moves towards the open ends of the electrodes 1 and 2 driven by the Lorentz's force of electric and magnetic fields formed between the inner electrode 1 and the outer electrode 2. When the plasma has passed the open ends of the electrodes, the plasma is pinched by the pressure of the magnetic field, and forms a high-temperature, high-density plasma on the axis of the electrodes at a position near the open end thereof, thereby emitting soft X-rays. A magnetic field for preventing charged particles which are emitted from the plasma, from impinging upon a beryllium window 9, is formed by a pole piece 8 and coils 10, and is prevented from entering the discharge space 7 by a shield 11. FIG. 1 shows a case where the present embodiment is applied to an X-ray exposure apparatus. The X-rays emitted from the plasma are introduced into an exposure chamber 12 through an aperture provided at the center of the shield 11, to irradiate a wafer 13 which is coated with a resist, through a mask (not shown). In the present embodiment, the magnetic field for preventing charged particles from impinging upon the beryllium window 9 is generated by an electromagnet. Alternatively, the above magnetic field may be generated by a permanent magnet.

As mentioned above, in the present embodiment, a pulse voltage from the charged capacitor 5 is applied between the inner electrode 1 and the outer electrode 2 so that the outer electrode 2 is at a positive potential with respect to the inner electrode 1. Further, the outer diameter of the inner electrode 1 is equal to 30 mm, the inner diameter of the outer electrode 2 is equal to 75 mm, the total length of each of the inner and outer electrodes is equal to 170 mm, and the creeping distance of the insulator 3 is equal to 40 mm. The capacitor 5 has a capacitance of 55 $\mu$F, and to a voltage of 8 KV. In a case where the capacitor 5 thus charged is discharged so as to deliver an energy of 1.76 KJ to the discharge tube filled with argon, the optimum pressure of argon is 0.18 Torr. While, in a case where the inner electrode is used as an anode, an optimum argon pressure of 0.32 Torr is required for carrying out the same discharges mentioned above. That is, according to the present embodiment, the optimum argon pressure is lower than that in the prior art, and moreover the amount of generated X-rays is about twice larger than that in a case where the inner electrode is used as an anode.

As has been explained in the foregoing, according to the present invention, a pulse voltage is applied between a pair of coaxial cylindrical electrodes of a plasma focus so that the inner one of the electrodes is at a negative potential with respect to the outer electrode, to enhance plasma-focusing efficiency. Thus, the optimum pressure of a gas filled in the discharge tube can be decreased, and the absorption of X-rays by the gas can be reduced. Further, electrons traveling from a plasma to an X-ray transmitting window can be readily prevented from impinging upon the window by a magnetic field. Accordingly, a thin film can be used as the window, and thus the absorption of X-rays by the window can be reduced. That is, strong X-rays are introduced into an exposure chamber. It was confirmed by experiments that the intensity of X-rays emitted from a plasma focus X-ray source according to the present invention could be readily made about twice stronger than the intensity of X-rays emitted from a conventional plasma focus X-ray source. Further, according to the present invention, the background X-rays emitted from an electrode can be reduced in a great degree. Thus, when a plasma X-ray source according to the present invention is used in an X-ray exposure apparatus or X-ray microscope, high quality patterns can be formed by X-rays. Furthermore, according to the present invention, the temperature rise of an anode can be reduced, and moreover the anode can be readily cooled. That is, a plasma X-ray source according to the present invention can exhibit the above-mentioned remarkable effects, by reversing the polarity of a pulse voltage applied to a plasma focus.

We claim:

1. A plasma X-ray source comprising:

an inner cylindrical electrode;

an outer cylindrical electrode disposed coaxially with the inner cylindrical electrode, with a desired gap therebetween;

an electrically insulating member provided between the inner cylindrical electrode and the outer cylindrical electrode so that breakdown occurs along a surface of said electrically insulating member when high voltage is applied between the electrodes;

a discharge vessel containing the inner and outer cylindrical electrodes therein and filled with a gas selected from a group consisting of neon, argon, kyrpton and xenon and mixtures thereof, said gas being convertible into a plasma; and means for applying a pulse voltage between the inner and outer cylindrical electrodes so that the inner cylindrical electrode is at a negative potential with respect to the outer cylindrical electrode, to generate the plasma within the discharge vessel.

2. A plasma X-ray source according to claim 1, wherein an X-ray transmitting window is located in front of an end of the inner electrode.

3. A plasma X-ray source according to claim 2 wherein shield means having aperture is located between the inner electrode and the X-ray transmitting window.

4. A plasma X-ray source according to claim 3, wherein deflection means for deflecting charged particles emitted from the plasma is located between the shield means and the X-ray transmitting window.

5. A plasma X-ray source according to claim 4, wherein the deflection means comprises a pole piece and coils.

* * * * *